US006264792B1

(12) United States Patent
Kuosa et al.

(10) Patent No.: US 6,264,792 B1
(45) Date of Patent: Jul. 24, 2001

(54) METHOD FOR PRODUCING CALENDERED PAPER

(75) Inventors: Harri Kuosa, Järvenpää ; Markku Kyytsönen, Numminen; Juhani Partanen, Järvenpää ; Kari Sipi, Espoo; Eero Suomi, Häeenlinna; Antti Heikkinen, Helsinki; Mikko Tani, Tuusula; Juha Lipponen, Palokka; Mika Tammenoja, Jyväkylä ; Kari Juppi, Palokka, all of (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/191,227

(22) Filed: Nov. 13, 1998

Related U.S. Application Data

(60) Provisional application No. 60/065,980, filed on Nov. 14, 1997.

(51) Int. Cl.[7] ..... D21F 11/00

(52) U.S. Cl. ..... 162/198; 162/198; 162/DIG. 10; 162/DIG. 11; 162/252; 162/262; 162/253; 162/258; 162/259; 162/263; 100/70; 100/73; 100/74; 100/92; 100/302; 100/308; 100/309; 100/310; 100/327; 100/328; 100/329; 100/330; 100/331; 100/332; 100/334; 100/335; 100/336; 73/159

(58) Field of Search ..... 73/159; 162/198, 162/252, 262, 253, 258, 259, 263, DIG. 10, DIG. 11; 100/70, 73, 74, 92, 302, 308, 309, 310, 327–336

(56) References Cited

U.S. PATENT DOCUMENTS

| | | | | |
|---|---|---|---|---|
| 3,864,842 | * | 2/1975 | Sawyer | 34/41 |
| 3,989,085 | * | 11/1976 | Crosby | 162/198 |
| 4,378,639 | * | 4/1983 | Walker | 34/12 |
| 5,286,348 | | 2/1994 | Perin . | |
| 5,438,920 | * | 8/1995 | Koivukunnas et al. | 100/38 |
| 5,649,448 | * | 7/1997 | Koskimies et al. | 73/159 |
| 5,756,156 | * | 5/1998 | Elijoki et al. | 427/316 |

* cited by examiner

*Primary Examiner*—Stanley S. Silverman
*Assistant Examiner*—Mark Halpern
(74) *Attorney, Agent, or Firm*—Cohen, Pontani, Lieberman & Pavane

(57) ABSTRACT

A method and apparatus for producing calendered paper by an on-line manufacturing system comprising at least a paper machine and a multi-nip calender. The method comprises following steps: removing water from a formed paper web by pressing, drying the pressed paper web by at least one dryer, calendering the dried web by the multi-nip calender, measuring a cross-machine moisture profile or a variable relative thereto, and altering the moisture of the web so that the moisture profile of the web in the cross-direction is even when the web enters the first nip of the calender.

29 Claims, 6 Drawing Sheets

Woodcontaining Printing Papers
Quality Targets

| Paper Grade | Brightn. | Opacity % | Gloss % | Smoothness PPS10 | Density kg/m³ | Porosity Bendtsen |
|---|---|---|---|---|---|---|
| News | 64 | 94 | 10-15 | 3.0-3.5 | 600 | 120 |
| SC-C | 67 | 93 | 25-30 | 1.8-2.5 | 800 | 60 |
| SC-B | 67 | 93 | 30-35 | 1.4-1.6 | 1000 | 40 |
| SC-A | 67 | 93 | 40-45 | 1.0-1.2 | 1100-1200 | <20 |
| Surface news | 64 | 93 | 10-15 | 3.0-3.5 | 600 | <100 |
| Pigmented news | 67-71 | 94 | 10-20 | 2.5-3.0 | 800-900 | <10 |
| Surface S SC | 67-71 | 92 | 35-40 | 1.4-1.6 | 1100 | <15 |
| Pigmented SC | 71 | 93 | 35-40 | 2.0-2.5 | 900-1000 | <8 |
| Coated SC | 71 | 93 | 45-60 | 1.2-1.8 | 1000-1100 | <5 |
| MFC 55-70 | 71-75 | 93 | 20-25 | 2.0-2.5 | 900-1000 | <5 |
| LWC 35-55 | 68-71 | 90 | 50-55 | 1.0-1.2 | 1200 | <3 |
| LWC 55-70 | 71-75 | 91 | 55-65 | 0.8-1.2 | 1200 | <3 |
| Single MWC 70-90 | 75-80 | 92 | 65-70 | 0.6-0.8 | 1200 | <3 |
| Double T MWC 70-90 | 75-80 | 92 | 65-70 | 0.8-1.0 | 1200 | <3 |
| Double C MWC 70-90 | 75-80 | 92 | 65-70 | 0.6-0.8 | 1200 | <3 |

Fig. 6

METHOD FOR PRODUCING CALENDERED PAPER

This application claims benefit of Provisional No. 60/065,980 filed Nov. 14, 1997.

FIELD OF THE INVENTION

The present invention relates to a method and apparatus for producing calendered paper that is finished with an on-line multi-nip calender like a supercalender, opti-load calender or a Janus Concept Calender. More specifically, the invention relates to controlling the cross-machine moisture profile of the paper web so that an optimum quality of the calendered paper is achieved.

BACKGROUND OF THE INVENTION

This invention relates to manufacturing of high-gloss high quality magazine paper grades by using on-line calendering. In on-line calendering the calender is arranged directly after a paper machine or a coater and the web is also led directly to the calender. This kind of calendered paper grades have previously been produced by off-line calenders and normally two or three calenders have been used for handling paper produced on one production line and the paper has been rolled before calendering. The speed of prior supercalenders has limited their use as on-line calenders. However, today's development of modern supercalenders and new multi-nip calenders has made it possible to increase the operational speed of these calenders to the level of the production speed of paper machines and coaters, which has made it possible to use these calenders also in on-line configurations. All multi-nip calenders comprise several nips formed of soft and hard rolls. The outer surface of the soft rolls is made of paper or other tightly pressed fiber material or a suitable polymer material. The hard rolls are made of steel, and most of the hard rolls can be heated by oil, water steam or by other means, like electric induction.

The purpose of the calendering is to increase the smoothness, gloss and other properties of the printing surface of the paper. These improved properties of the printing surface improve the final quality of the printed sheet. The printability of paper and the quality of the printed surface are primary quality factors that are valued by the users of paper.

The smoothing of the paper surface is achieved by simultaneously subjecting the fiber structure to high pressure and heat by heating the hard rolls and pressing the rolls together so that a high linear nip force is created on the nips between the rolls. Under the influence of these forces the fibers forming the paper reach their glass transit temperature, and the deformation caused by the nip load is permanent. Sliding of the paper surface on the surface of the rolls may also cause deformation of the fibers and increase the smoothing effect.

When multi-nip calendering has been used, the paper has been traditionally produced in a paper machine and subsequently coated if so desired. In both cases the coated or uncoated paper has been rolled on storage rolls and calendered in separate calenders. The paper has been dried to a very low moisture, typically to 1–3% calculated from total weight of the paper. Before calendering, the paper is rewetted up to a higher moisture content required for good calendering results, typically to 6–10% calculated from the total weight of the paper. The reason for drying to very low moisture content is to level out the cross machine (CD) moisture profile. The short storage on storage rolls before calendering also evens out the moisture of the paper on the roll as well as rewetting before calendering. In present on-line calendering concepts, the paper is dried to a very low moisture content before calendering and wetted just before calendering. The process is therefore almost the same as on off-line calendering, only without moisture settling storage.

The rewetting can be done, for example, with the a water spray application units described in the U.S. Pat. No. 5,286,348 which is incorporated herein by reference, which describes a rewetting apparatus for providing a good moisture profile in the CD direction.

The problem associated the drying and subsequent rewetting of the paper is the time needed for paper to absorb the water and the moisture to even out, especially in the direction of the thickness of the paper and over the surface area of the web. If the rewetting is done just before the calendering, the uneven moisture profile will effect the final surface properties of the produced paper, and the quality grading of the paper is lowered. As stated above, the paper rolls have been reeled up after rewetting and transferred to a waiting station for moisture equalization, whereafter the rolls have been brought to off-line calenders for final calendering for producing a high gloss and to densify the surface of the paper. In these off-line systems, no need for improvement in moisture control was needed, because traditionally supercalendered paper grades like SCA and LWC were calendered in off-line calenders at lower speeds than the speed of the paper machine and there was enough time for settling of the moisture on the storage rolls.

The drying and rewetting process adds to energy consumption required for paper making and to the required space compared to a process where there is no rewetting and overdrying before calendering. Uneven moisture profile results in uneven gloss and uneven thickness profiles because of the effect of the moisture to the fiber deformability. If the thickness profile is uneven, it results in difficulties in winding and may even cause cross-directional bumps in the client or customer rolls. The CD-bumps decrease the runnability of the paper in printing presses and converting machines and by this way decrease the quality of the material from the customer's point of view.

The moisture profile effects many factors of the paper making process and properties of the paper. One very notable feature is that when moisture profile differences are present in the paper, the dryer parts of the paper start shrinking earlier and they shrink more than the wet parts, which leads to stretching of the wet parts. The uneven stretching leads to shrinking of the dry parts and stretching of the wet parts, which further leads to thickness variation, variation in shrinkage and variation of the properties of the paper. A more detailed description of the effect of the moisture and moisture variations is presented with the detailed description of the invention.

The moisture profile of the paper that is produced is controlled presently in several ways, especially at the beginning of the web formation. The purpose of the control of the moisture profile in present technology is to ensure good runnability of the machine and the product that is produced. This is understandable, since there is a strong relationship between the moisture profile and the tension profile. In off-line calendering, the moisture profile is preferably kept as even as possible in those parts of the manufacturing process where the effect of the tension profile is highest on the runnability. The tensions induced into the web by moisture variations and the tension profile do not effect the properties of the final product as such since the tensions have time to relaxate during the waiting or storage time before calendering. Normal waiting time in a modern paper mill producing off-line calendered paper is about 1–5 hours. Present moisture control methods to do take into account the requirements of multinip on-line calendering, and therefore the quality of the calendered paper may even be adversely affected by present moisture control procedures.

SUMMARY OF THE INVENTION

According to the present invention, the cross-directional moisture profile of the paper web being produced is measured at at least one position on the production machine, whereafter the web is handled with moisture altering means at at least one position on the production machine so that the cross-directional moisture profile of the web is effected so that the moisture profile of the web is evened out before calendering and a best possible calendering result in an on-line multi-nip calender is achieved.

The moisture profile measurement may be done directly or by measuring a value that indicates the value of moisture indirectly. Such indicator is, for instance, web tension which varies as a function of the web's moisture because the strength of the web varies according to its moisture content. The web moisture measurement may be taken at any position on the production line, but in order to guarantee an even cross-directional moisture distribution at the calender, at least one moisture measurement point has to be positioned at the end of the machine on the area that is before the last apparatus that effects the moisture profile and before winder.

According to the other aspects of the present invention, the moisture profile can be adjusted by temperature control of the web or drying cylinders or other means capable of effecting the temperature of the web.

According to the further aspects of the invention, the moisture profile adjustment and control may be done for web having a solids content of about 60% or less by moisturizing using water, steam, hot or cold air, infrared dryer or microwaves. When the solids content of the web is about 60% to about 85% the moisture profile control should be done by methods effecting the temperature, by hot or cold air, by infrared dryer or by microwaves. When the solids content is over about 85%, moisturizing methods like water or steam handling may be again used.

The invention provides, among others, the following benefits. Need for drying the paper and then rewetting it is not required, whereby the energy consumption is smaller. and the machine may be built shorter. The thickness profile and gloss of the paper is improved. The runnability of the paper in printing press is better and the overall customer quality can be raised.

Other objects and features of the invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

FIG. 6 is a chart showing typical paper grades that can be manufactured according to the invention.

DETAILED DESCRIPTION OF THE PRESENTLY PREFERRED EMBODIMENTS

Present moisture profiling strategies do not take into account the effect of the profiling into the structure of the end product and the further processing potential. The significance of the stresses left in the paper and its possible structural faults is enhanced in an on-line calendering process wherein the stresses do not have time to relax before drying since the calandering is done a few milliseconds after the web leaves the last drying apparatus. In view of the morphology of the fibers, the behavior of the fiber web under drying can be dealt into stages according to the solids content of the web. When the solids content is about 50–55%, the solids content increases without changes in the fiber morphology. As the solids content increases from about 50–55% to about 60–65%, flattening of the fibers starts on the fiber crossing points (linking points) but no changes happen on the surface of the web. When solids content is about 60–65% to about 70–75%, wrinkles that are directed parallel to the longitudinal axis of the fibers start to emerge and the flattening of the fibers continue. On solids contents of about 70–75% to about 80–85% the fibers start to shrink in the cross-direction on their unlinked parts, flattening of the fibers continues and the longitudinal wrinkles increase. When the solids content rises to about 80–85% to 90%, the fibers start to shrink in the cross-direction also at linked parts, cross-directional shrinking continues and the wrinkles can be seen clearly. The morphology of the web reaches its final form at solids content of about 90%. The shrinking of single fibers is greatest on solids contents of about 60–85%.

On twin-wire machines the shrinking starts earlier than on single wire machines. On twin-wire machines the starting point is about 55% solids and on single wire machines about 65%. On both machine types the cross-directional shrinking continues from the beginning of the shrinking to the end of the drying. The increase of the shrinkage is approximately linear as a function of the solids content The presented values, are average values and the properties of wood mass or fiber mass material, manufacturing method of the bulk mass and its handling effect the solids content values on which the changes in the morphology happen.

The theory behind the morphology of the fibers provides the following possibilities to control the moisture profile.

Method A

Figure 1:
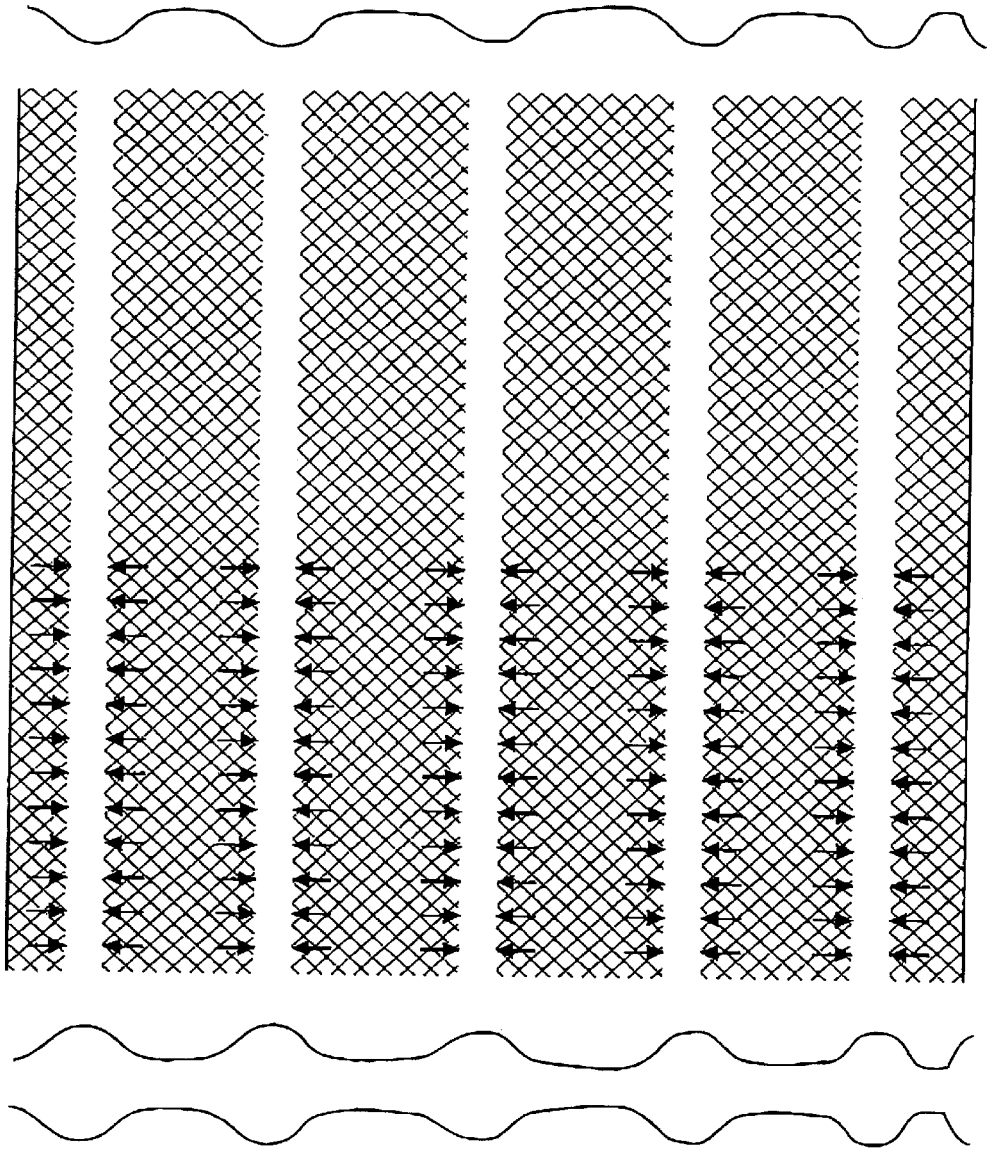
FIG. 1 is a diagram of the effect of the cross machine moisture variation on a web to be produced.

Levelling the moisture profile before the strong shrinkage of the paper begins means that the measurement and the adjustment of the moisture profile has to be done on the wet pressing zone of the paper machine, and the solids content is about 60% at the highest, depending on the grade that is manufactured. This method is favorable for several reasons. If significant changes in the moisture of the paper are present when it starts to shrink, the dryer parts start to shrink earlier than the wetter parts (see FIG. 1). The wet parts stretch in the cross-direction, and the dryer parts shrink and become more dense. This can lead to thickness variation, drying shrinkage variation and variation in the properties of the produced paper. The shrinkage of the paper is situated on the same physical phase as the so-called phase of decreasing evaporation rate. Typical for this phase is that the surfaces of the web are almost dry, and the middle part is considerably wetter. In that phase, the surfaces carry most of the forces imposed to the web in the machine direction. If water is added on the web at this stage, the water breaks bonds between the fibers, and that part of the web weakens considerably in relation to its surroundings. Therefore a big shrinkage and stretching area is induced surrounding this area.

The evenness of the cross-directional properties of the paper formed in the drying stage of the paper are an essential requirement so that the paper can be pressed enough in the calendering stage in the manufacture of, for example on-line calendered SC-paper. If that can not be achieved, and there is essential variation in the thickness, the modulus of elasticity, the drying shrinkage or the density before calendering, that will make the production of large machine rolls difficult. Even more important is that in worst cases the quality of the paper delivered to the customers is decreased.

On the solids content area, from wet pressing to about 60% solids content, adjustment of the moisture profile may be done by the following mechanisms: with moisturizing by water or steam, by treating the web with hot or cold air, by infrared dryers, by microwaves or by differentially heatable or coolable cylinders. The water and steam handling methods may be called wetting methods and the other methods are based on either increasing the evaporation rate of the water from the web or decreasing it by cooling the web. Examples of suitable apparatuses are presented below.

Method B

The moisture profile control for an area with about 60–85% solids content should be done by methods based on temperature control, like by treating the web with hot or cold air, by infrared dryers, by microwaves or by heatable or coolable cylinders Wetting methods should not be used on this area because of reasons relating to powerful shrinkage on this area.

Method C

If the solids content of an area is above about 85%, all methods suitable for use on method A can be used since no significant shrinkage happens. Such an area has the solids content of a wet web during coating, wherefore for coating machines the same profiling methods may be used. If coated paper is manufactured, it is important that the adjustment of the moisture profile is done at least after the last coating station since the wet coating mixture may change the moisture profile because of varying absorption properties of the base paper, for example.

Total mixture profile controlling concept for a paper machine

Figure 2:
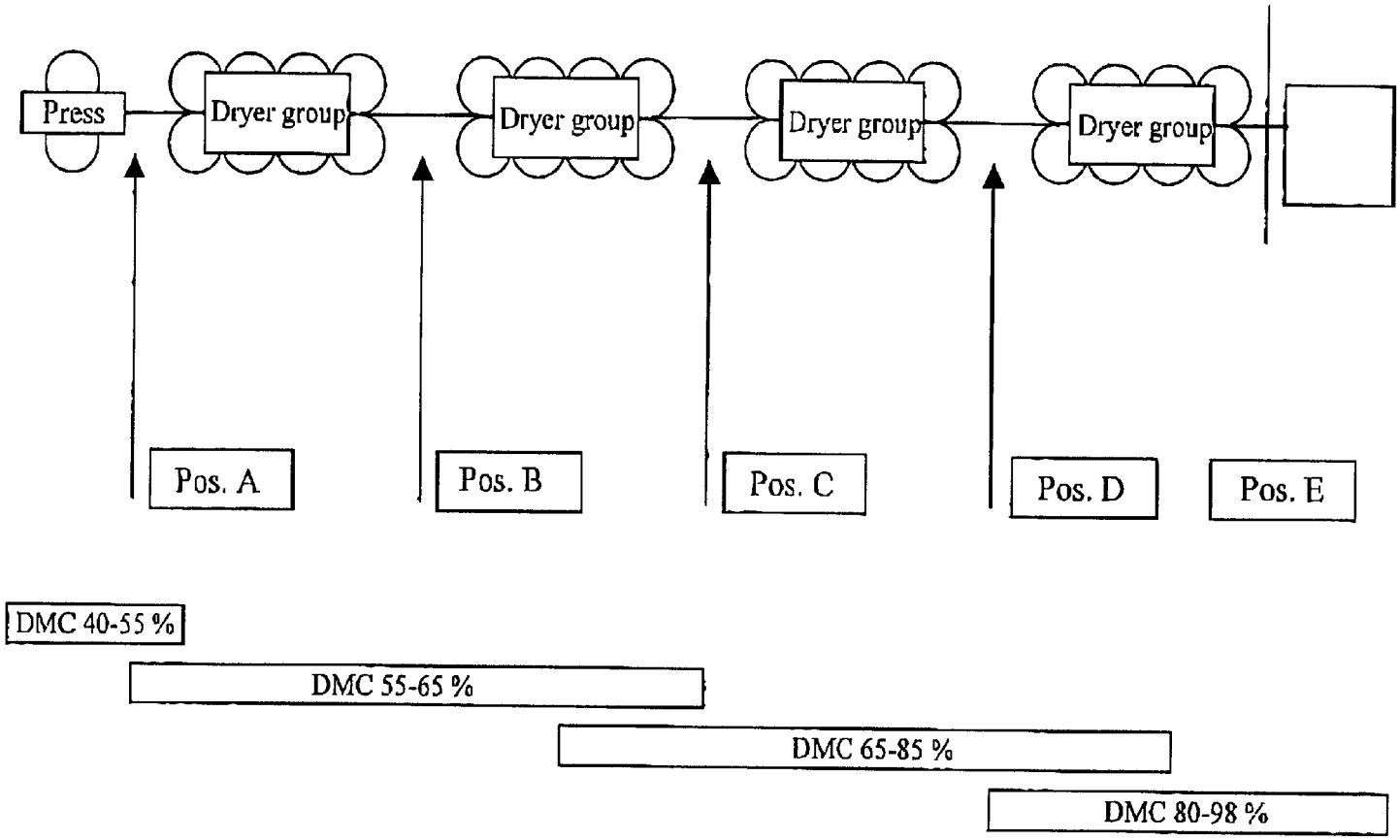
FIG. 2 is a schematic view of the implementation of the invention.

One embodiment of the invention is presented schematically in FIG. 2. FIG. 2 describes a press section of a paper machine and subsequent dryer groups. Dryer groups may consist of drying cylinders, infrared dryers, air dryers or other dryers, or they may be any combination of commonly used dryer types. Dry matter contents (DMC, solids content) in different stages of web formation are presented in the bottom of the FIG. 2. As can be seen in the FIG. 2, the solids content of a web leaving the press section of a paper machine is about 40–55% and after first dryer group the solids content rises to about 60% and increases gradually as the drying process proceeds. At positions D and/or E the web may be dried to a solids content so that the moisture content is below that at which the paper is actually used.

Wet pressing after formation of the paper can be done by a conventional press or preferably by a modern shoe press since the shoe press equalizes the small scale moisture variation effectively. Moisture profiling can be performed at the press section by profiling rolls or by steam. In this case, the profiling means are controlled with measurement instruments located at position A. The measuring method may be a moisture measurement, temperature measurement, tension measurement or other method that indicates the moisture profile of web in the cross-machine direction. A very well suited method for measurement and control of different variables in paper making process is disclosed in U.S. Pat. No. 5,649,448, which is incorporated herein by reference. At positions A and/or B may be a moisture adjusting apparatus used in Method A. The adjusting apparatus is controlled by a feed-forward or by a feedback control method or both according to whether the measurement of the moisture profile is done before or after the adjusting apparatus. At positions C and/or D, a moisture adjusting apparatus used in Method B may be used. The adjusting apparatus is controlled by measurement results as described above.

At positions D and/or E may be located an adjustment apparatus according to Method A. The apparatus may be a wetting apparatus like a water or steam application apparatus only if the structure of the paper withstands the operation of the apparatus and the dry matter content is at least about 85%. It is considered that the structure of the paper withstands the use of moisturizing if the amount of water used and the solids content permits the use of the apparatus without consequences described in description of Method A.

After position E, the web may be forwarded to an on-line multi-nip calender or to an on-line coating machine depending on the paper grade that is manufactured. The moisture profile must be controlled also during coating, and all adjusting apparatuses may be used, since the solids content of the web is normally higher than about 85% during coating since the web has already been dried to a solids content below that during the formation and drying phases. In the following, different methods usable for moisture profiling are described. These methods and apparatuses are suitable for moisture adjustment both on paper machine and on coater if the limitations discussed above are taken into account. The methods and apparatuses described below may be used alternatively or simultaneously.

A profiling steam box controlled by CD profile measurements located after, or downstream of, the profiling steam box may be used in the press section of a paper machine. The steam box is preferably after the first drying cylinder group and the measurements are preferably moisture profile, tension profile or temperature profile measurements or any combination of these measurements. Since in paper machines quality control and control systems are already monitored by several measurement instruments, all of these measurement methods are easily adaptable to new designs. The CD temperature may be controlled either by cooling the web or by heating it. The temperature adjustment may be done at at least one, of the drying cylinder groups, and preferably at the last group to achieve uniform temperature profile in the cross-direction of the web. The temperature measurement unit may be located at or after the CD temperature adjustment unit in or between drying cylinder groups or after the last drying cylinder group.

Moisture profile adjustment may be performed before the last drying cylinder group by profiling the drying cylinder surface temperatures and/or using profitable infrared drying units to adjust the moisture of the web and/or by using rewetting equipment for profile corrections. The temperature and/or moisture profile measurement may be done by instruments located in or after the last drying cylinder group.

Since the wetting and heating methods that may be used for moisture profile control may effect the dimension, stability and water absorption properties of the web, cooling of the web provides benefits over those methods since the effects of cooling on the mentioned properties of the web are smaller that those of wetting or heating methods. When cooling is used for profiling, the temperature of the dryer sections of the web is decreased, whereby the evaporation decreases. This method minimally effects the properties of the fibers. The temperature adjustment may be done in several ways, for example by cooling a drying cylinder sectionally with air or very fine water mist that evaporates from the cylinder without moisturizing the web significantly. The effect of water cooling is based on the fact that energy is needed for evaporating the water. Profiling by cooling may also be done by blowing cold air from a penetrating discharge air dryer. If profiling is done in several locations successively, the moisture profile can be controlled with minor changes without detrimentally effecting other important properties of the web. The web may also be cooled down to the machine temperature or the temperature of the machine housing before a calendering unit to prevent the continuation of drying of the paper between the calender and the last drying equipment. This prevents uneven moisture evaporation from the web before calendering. When the web enters the calender, the preferable moisture content is about 7% to about 20% calculated from the total weight of the web.

Final moisture profile adjustment may be done also by applying water in the form of a steam spray or a thin film transferred on the paper in calender nip or by a surface sizing unit inside a drying cylinder group or between the last drying cylinder and the calender. In this case, the CD moisture profile measurement may be located immediately before the calender, or after the calender before the winding unit. A film transfer unit or a surface sizing unit may be used for moisture profiling by controlling the thickness of the water film or sizing agent film applied to the film transfer roll.

Figure 3:
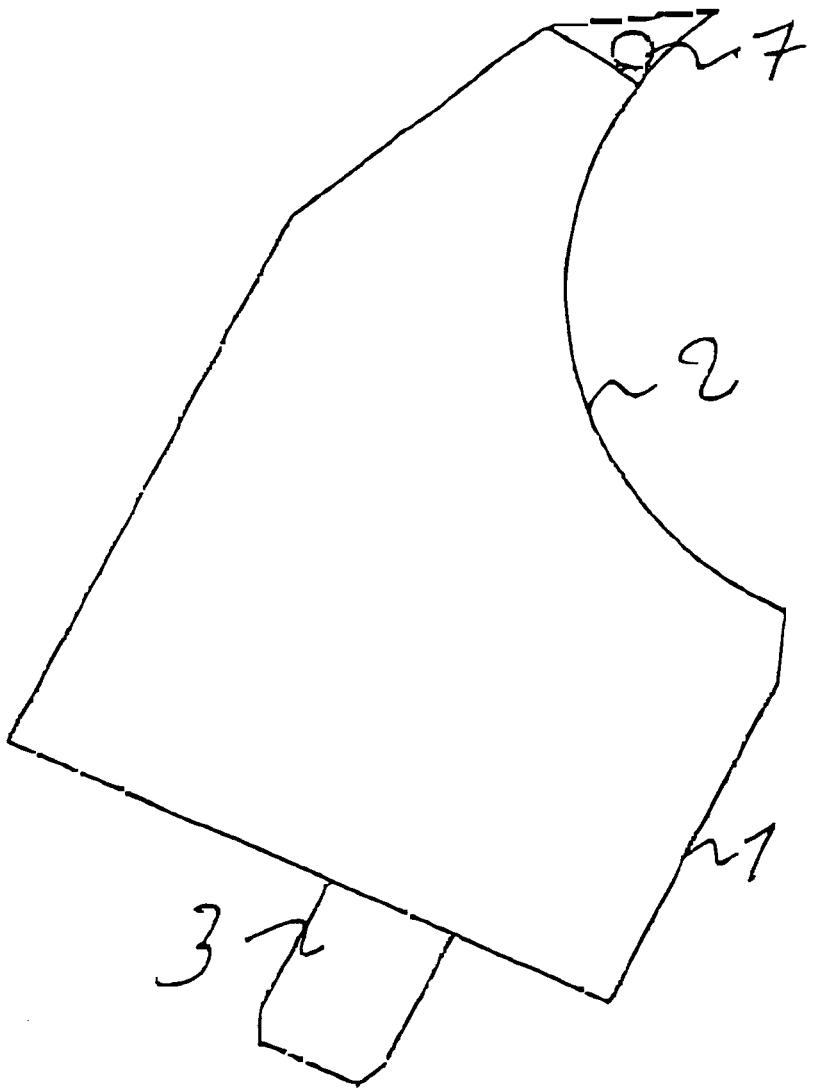
FIG. 3 shows schematically in side view an apparatus that can be used for implementation of the invention.
Figure 4:
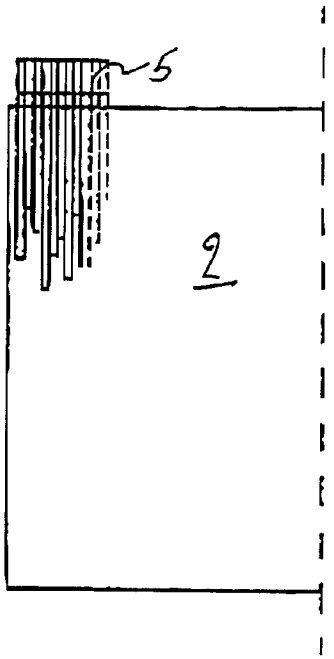
FIG. 4 shows schematically in top view an apparatus that can be used for implementation of the invention.
Figure 5:
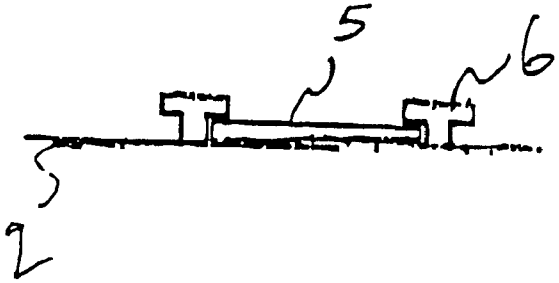
FIG. 5 shows schematically a detail of the apparatus shown in FIGS. 3 and 4.

FIGS. 3–5 show diagrammatically a profiling blow box that can be used either for cooling or heating of a web. The box-comprises a housing 1 that forms a nozzle surface 2 that is designed to contour a roll over which a web is running. Air or steam can be blown into the housing 1 through coupling 3 and the same is blown from the housing 1 through the nozzle surface 2 against the web. The nozzle surface 2 comprises an arrangement of movable bands 5 arranged to move between guides or rails 6. One end of the bands is wound around an actuating shaft 7 that is divided into sections so that each band has its own actuating section. By turning the actuating section it is possible to move the bands between the rails 6 so that they cover different lengths of the area of the nozzle surface. If the bands are narrow, for example about 10 to about 100 mm wide, the apparatus can be used for compensation of small scale variations of the moisture profile. By other apparatuses it may be difficult to obtain as finely graduated profile control as with this apparatus.

The moisture profile control and adjustment is preferably done by more than one of the above described ways. If several correction steps are used, the need for major adjustments in one step is prevented and the effects on the process and the paper are smaller. Also the control of the apparatus becomes easier.

The invention may be used for several types of multi-nip calenders that are characterized by multiple calendering, nips and relatively high nip loads. Examples of these kind of calenders are supercalenders, Janus concept calenders (see Paper Asia, October 1997, enquiry card No.: 10/007), a calender shown in the U.S. Pat No. 5,438,920 or other types of multi-nip calenders used for manufacturing high gloss paper grades. Examples of the paper grades suitable for manufacturing according to the invention and their properties are shown in FIG. 6, which is self-explanatory.

Thus, while there have been shown and described and pointed out fundamental novel features of the invention as applied to a preferred embodiment thereof, it will be understood that various omissions and substitutions and changes in the form and details of the invention may be made by those skilled in the art without departing from the spirit of the invention. For example, it is expressly intended that all combinations of those elements and/or method steps which perform substantially the same results are within the scope of the invention. Substitutions of the elements from one described embodiment to another are also fully intended and contemplated. It is also to be understood that the drawings are not necessarily drawn to scale but they are merely conceptual in nature. It is the intention, therefore, to be limited only as indicated by the scope of the claims appended hereto.

What is claimed is:

1. A method for producing calendered paper by an on-line manufacturing system comprising a paper making machine and a multi-nip calender, said method comprising:

removing water from a formed paper web by pressing the web in a press section of the paper making machine;

drying the pressed paper web with at least one dryer in a dryer section of the paper making machine;

calendering the dried web with the multi-nip calender;

measuring one of a cross-machine moisture profile of the web and a characteristic of the web indicative of a cross-machine moisture profile of the web; and altering moisture content of at least a portion of the web so that the moisture profile of the web in the cross-machine direction is substantially even when the web enters a first nip of the multi-nip calender.

2. The method of claim 1, wherein the moisture of at least a portion of the web is altered by applying steam to the web using a steam box located within the press section of the paper making machine, and wherein said measuring is done downstream of the steam box.

3. The method of claim 2, wherein said measuring is done downstream of a dryer of the paper making machine and the dryer is downstream of the press section of the paper making machine.

4. The method of claim 1, wherein the moisture of at least a portion of the web is altered by changing the temperature of a portion of the web with a temperature altering means so as to affect a rate of evaporation of water from the web.

5. The method of claim 4, wherein the temperature of the web is altered by cooling the web across at least a portion of a width of the web.

6. The method of claim 4, wherein the temperature of the web is altered by heating the web across at least a portion of a width of the web.

7. The method of claim 4, further comprising measuring a cross-machine temperature profile of the web at a point downstream of the temperature altering means.

8. The method of claim 7, wherein the temperature profile of the web is measured at one of the following locations: immediately downstream of the temperature altering means, between a pair of dryers, and between a last dryer of the dryer section and the multi-nip calender.

9. The method of claim 8, wherein said measuring of one of a cross-machine moisture profile of the web and a characteristic of the web indicative of a cross-machine moisture profile of the web is done at one of said temperature profile measuring locations.

10. The method of claim 1, wherein the moisture of at least a portion of the web is altered upstream of a last dryer of the dryer section by one of the group comprising: a drying cylinder, an infrared dryer, a web rewetting means, a steam box, a penetrating air blower, a profiling blow box, and a water applying means.

11. The method of claim 10, wherein said measuring of one of a cross-machine moisture profile of the web and a characteristic of the web indicative of a cross-machine moisture profile of the web is done at one of the following locations: within a last group of dryers, and between a last dryer of the dryer section and the multi-nip calender.

12. The method of claim 1, further comprising cooling of the web downstream of a last dryer of the dryer section to ambient temperature.

13. The method of claim 1, where the moisture of at least a portion of the web is altered by applying water to at least a portion of the web.

14. The method of claim 13, wherein the water is applied to the web as one of a mist and a spray.

15. The method of claim 13, wherein the water is applied to the web as a film applied to a surface of the web.

16. The method of claim 15, wherein the film of water is applied to the web by one of a film transfer sizer and a film transfer coater.

17. The method of claim 13, wherein measuring of one of a cross-machine moisture profile of the web and a characteristic of the web indicative of a cross-machine moisture profile of the web is done at one of the following locations: immediately upstream of the multi-nip calender, and between the multi-nip calender and a winder.

18. The method of claim 1, wherein the moisture of at least a portion of the web is altered at a point where solids content of the web is less than about 60%.

19. The method of claim 18, wherein the moisture of at least a portion of the web is altered by one of the group comprising: a water applicator, a steam applicator, a hot air box, a cold air box, an infrared dryer, and a microwave dryer.

20. The method of claim 1, wherein the moisture of at least a portion of the web is altered at a point where solids content of the web is between about 60% and about 85%.

21. The method of claim 20, wherein the moisture of at least a portion of the web is altered by one of the group comprising: a hot air box, a cold air box, an infrared dryer, and a microwave dryer.

22. The method of claim 1, wherein the moisture of at least a portion of the web is altered at a point where solids content of the web is greater than about 85%.

23. The method of claim 22, wherein the moisture of at least a portion of the web is altered by one of the group comprising: a water applicator, a steam applicator, a hot air box, a cold air box, an infrared dryer, and a microwave dryer.

24. The method of claim 22, wherein the web is coated with at least one layer of coating by a coating machine upstream of the multi-nip calender.

25. The method of claim 3, further comprising changing the temperature of a portion of the web with a temperature altering means so as to affect a rate of evaporation of water from the web.

26. The method of claim 25, further comprising measuring a cross-machine temperature profile of the web at a point downstream of the temperature altering means.

27. The method of claim 26, wherein the temperature profile of the web is measured at one of the following locations: immediately downstream of the temperature altering means, between a pair of dryers, and between a last dryer of the dryer section and the multi-nip calender.

28. The method of claim 1, wherein in said measuring step, the cross-machine moisture profile of the web is measured.

29. The method of claim 1, wherein in said measuring step, the characteristic of the web indicative of the cross-machine moisture profile of the web is a characteristic other than web tension.

* * * * *